US010157600B2

(12) United States Patent
Goldsmith et al.

(10) Patent No.: US 10,157,600 B2
(45) Date of Patent: Dec. 18, 2018

(54) PERCUSSION ACCESSORY ADAPTED FOR ATTACHMENT TO A DRUM TENSION ROD

(71) Applicants: Griffin Wade Goldsmith, Los Angeles, CA (US); Wylie Quinn Gelber, Los Angeles, CA (US)

(72) Inventors: Griffin Wade Goldsmith, Los Angeles, CA (US); Wylie Quinn Gelber, Los Angeles, CA (US)

(73) Assignee: Griffin Wade GOLDSMITH, Los Angeles, CA (US)

( * ) Notice: Subject to any disclaimer, the term of this patent is extended or adjusted under 35 U.S.C. 154(b) by 0 days.

(21) Appl. No.: 15/710,572

(22) Filed: Sep. 20, 2017

(65) Prior Publication Data

US 2018/0182360 A1 Jun. 28, 2018

Related U.S. Application Data

(63) Continuation of application No. 15/388,504, filed on Dec. 22, 2016, now Pat. No. 9,773,481.

(51) Int. Cl.

| | |
|---|---|
| ***G10D 13/02*** | (2006.01) |
| ***G10D 13/06*** | (2006.01) |
| ***G10G 5/00*** | (2006.01) |

(52) U.S. Cl.

CPC ..... *G10D 13/026* (2013.01); *G10D 13/025* (2013.01); *G10D 13/06* (2013.01); *G10G 5/00* (2013.01)

(58) Field of Classification Search

CPC .... G10D 13/026; G10D 13/025; G10D 13/06; G10G 5/00

See application file for complete search history.

(56) References Cited

U.S. PATENT DOCUMENTS

| | | | | |
|---|---|---|---|---|
| 1,416,522 | A | 5/1922 | Straight | |
| 3,368,442 | A | 2/1968 | Wilcoxon | |
| 3,576,149 | A * | 4/1971 | Slingerland, Jr. ..... | F16M 11/14 84/421 |
| 3,704,645 | A * | 12/1972 | Grauso ..... | G10D 13/026 403/90 |
| 4,208,942 | A | 6/1980 | Henrit | |
| 6,075,190 | A * | 6/2000 | Mosser ..... | F16C 11/103 248/291.1 |
| 8,283,543 | B2 * | 10/2012 | McBain ..... | G10D 13/026 84/411 R |
| 9,390,693 | B2 * | 7/2016 | Kasha ..... | G10D 13/00 |
| 9,773,481 | B1 * | 9/2017 | Goldsmith ..... | G10D 13/026 |
| 9,842,574 | B2 * | 12/2017 | McFadden ..... | G10D 13/026 |
| 2004/0107820 | A1 * | 6/2004 | Chen ..... | G10D 13/026 84/421 |
| 2011/0052312 | A1 * | 3/2011 | Chang ..... | G10D 13/026 403/65 |
| 2014/0123831 | A1 | 5/2014 | Dunnett | |
| 2018/0182360 | A1 * | 6/2018 | Goldsmith ..... | G10D 13/026 |

* cited by examiner

*Primary Examiner* — Robert W Horn

(74) *Attorney, Agent, or Firm* — Jake M. Gipson; Stephen H. Hall; Bradley Arant Boult Cummings LLP

(57) ABSTRACT

Percussion accessories for reversible and interchangeable attachment to the head of a drum tension rod are disclosed.

14 Claims, 4 Drawing Sheets

PERCUSSION ACCESSORY ADAPTED FOR ATTACHMENT TO A DRUM TENSION ROD

CROSS-REFERENCE TO RELATED APPLICATION

This application claims priority to and is a continuation of U.S. application Ser. No. 15/388,504, filed Dec. 22, 2016 (currently pending).

TECHNICAL FIELD

This disclosure relates generally to percussion accessories for use with a percussion instrument such as a drum.

BACKGROUND

It is sometimes necessary or desirable for a percussionist playing a drum set to incorporate alternative percussion instruments in the midst of a song. In some cases the alternative percussion may be a hand-held instrument such as a shaker or jingle. In other cases the alternative percussion instrument may be one that remains stationary while being played directly by contact from the percussionist or indirectly when the percussionist strikes a drum to which the instrument is attached. Generally, for a hand-held instrument, incorporation requires a percussionist to interrupt his hand movements to reach for the alternative percussion instrument, which may adversely affect his performance. Thus, it is desirable to have alternative percussion instruments adapted to attach to the drum set in a manner that puts them close at hand so that a percussionist can incorporate them into the music with less disruption.

Because the need for specific percussion accessories may vary between individuals, or may vary between individual songs, it is desirable that the percussion accessories be readily removable and interchangeable. Also, because of vibration and impact caused by playing drums, it is desirable that the percussion accessories be securely attached to prevent them being dislodged during drum play.

SUMMARY

A percussion accessory adapted for connection to the head of a drum tension rod which comprises a support rod with a shaft at its proximal end and a female receptacle at its distal end complementary to the head of a drum tension rod, and a percussion instrument adapted to receive the shaft of the support rod.

A percussion accessory adapted for connection to the head of a drum tension rod which comprises a support rod with a shaft at its proximal end and a female receptacle at its distal end complementary to the head of a drum tension rod, and a percussion instrument with an aperture sized and configured to allow insertion of the shaft of the support rod through the aperture.

A percussion accessory adapted for connection to the head of a drum tension rod which comprises a percussion instrument having an integral support rod extending from the instrument, where the distal end of the support rod has a female receptacle complementary to the head of a drum tension rod.

An adapter for percussion instruments which comprises a support rod with a female receptacle at its distal end that is complementary to the head of a drum tension rod, and a proximate end with a mechanism for attaching a percussion accessory.

BRIEF DESCRIPTION OF THE DRAWINGS

The present invention will be explained, by way of example only, with reference to certain embodiments and the attached figures, in which:

FIG. 1B shows a sectional view of a threaded connection. FIG. 1C shows a sectional view of a ball-bearing connector. FIG. 1D shows a sectional view of a pin connector.

DETAILED DESCRIPTION

FIGS. 1-8 will be used as reference to describe certain embodiments of the present invention. FIGS. 1-8 are illustrative in nature and are not meant to the limit the present invention to the embodiments illustrated.

Embodiments of the present invention provide percussion accessories that are adapted to be removably attachable to the head of a drum tension rod. Although this disclosure refers to use with jingles, shakers, and snare wires, it will be readily understood that it is equally applicable to other types of percussion accessories which can be located advantageously at or near the edge of the drum surface.

Figure 1A:
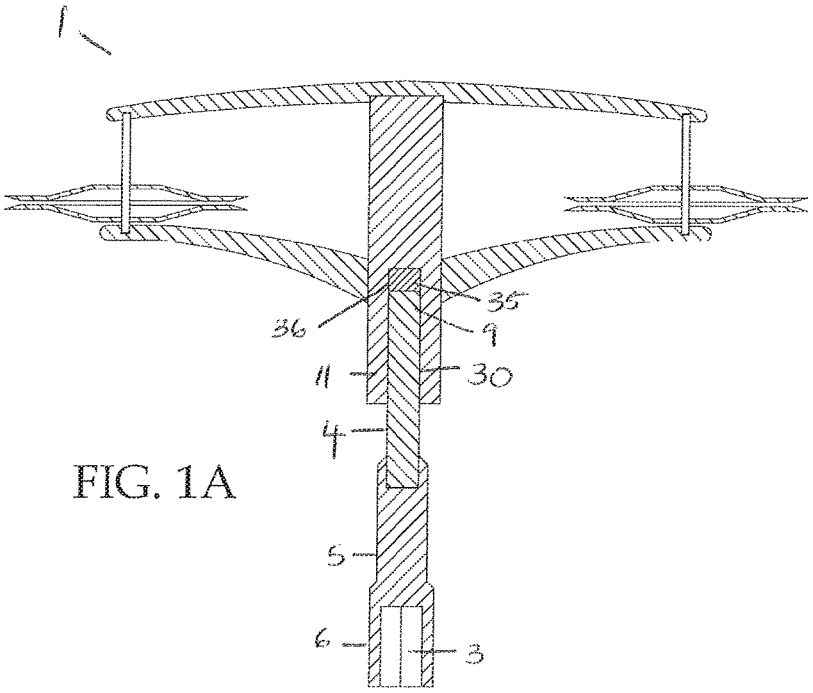
FIG. 1A shows a sectional view of an assembled jingle percussion accessory according to one embodiment.
Figure 1B:
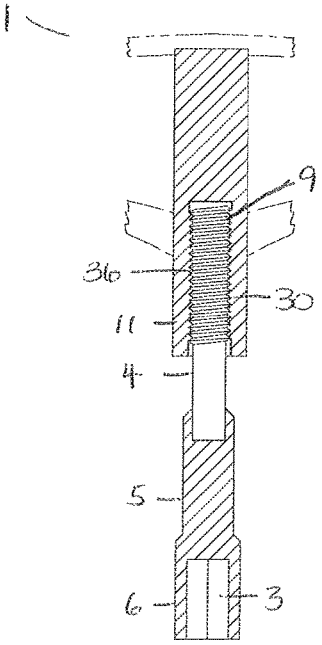
FIGS. 1B-1D show sectional views of securing mechanisms between a percussion accessory and a support rod according to alternative embodiments.
Figure 1C:
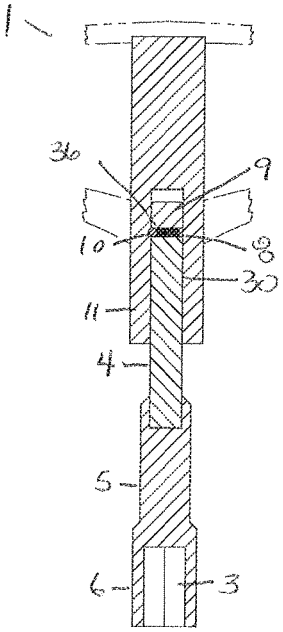
Figure 1D:
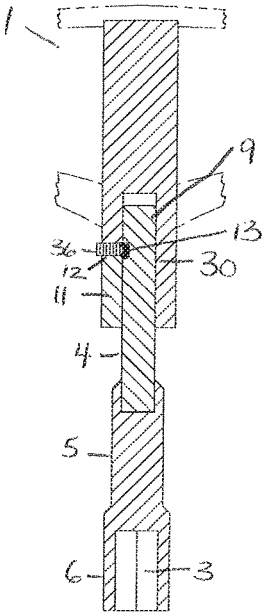
Figure 2:
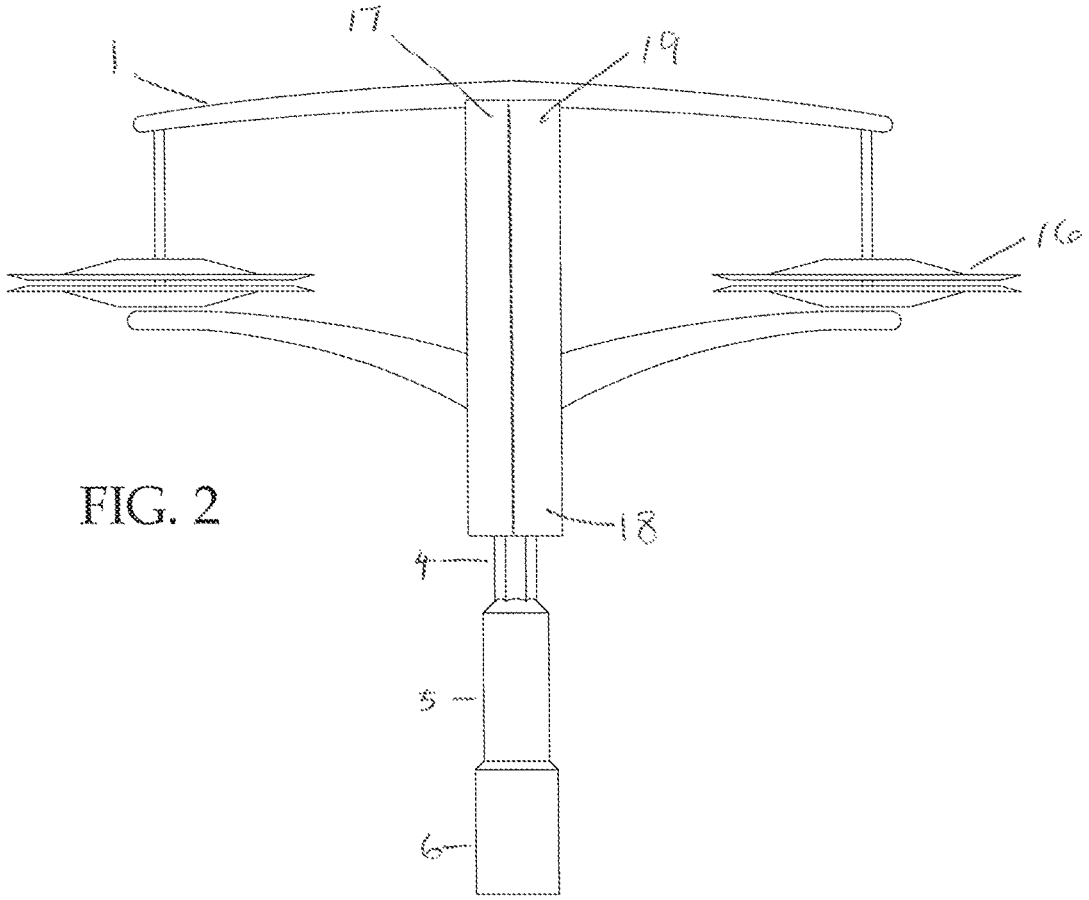
FIG. 2 shows a side view of an assembled jingle percussion accessory.
Figure 3:
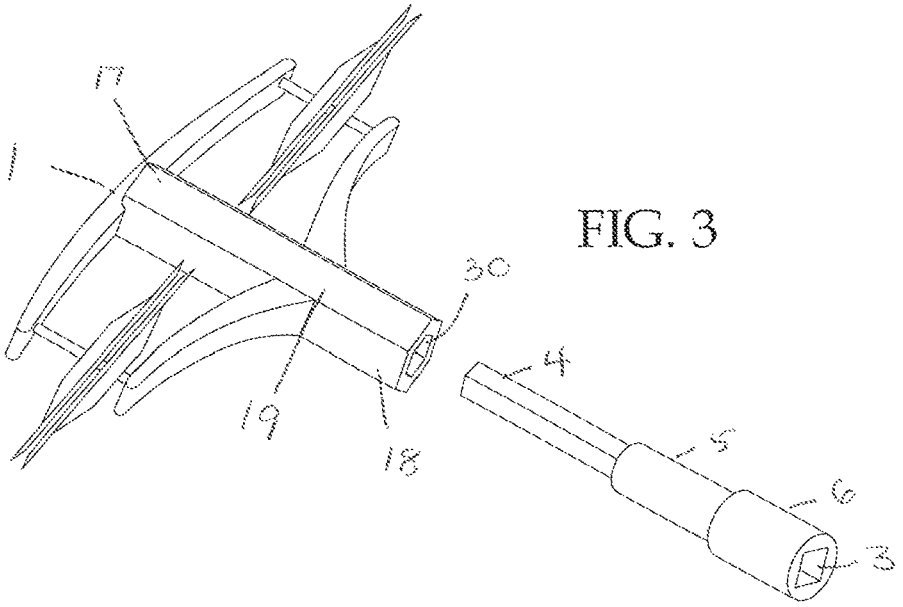
FIG. 3 shows an alternative view the jingle percussion accessory of FIG. 2 in a disassembled position.

As shown in FIGS. 1-3, in some embodiments a percussion accessory 1 is adapted to be removably attached to the head of a drum tension rod 2 in that the accessory 1 comprises a female receptacle 30 that is complementary to the shaft 4 of a support rod 5 mounted on the head of a drum tension rod 2. In some embodiments, the distal end 6 of the support rod 5 is adapted for connection to the head of the drum tension rod 2 by comprising a female receptacle 3 with a shape complementary to the head of a drum tension rod 2. The shaft 4 of the support rod 5 may be in the shape of a polygon, wherein rotational movement of the percussion accessory 1 is restricted by its engagement with the shaft 4 of the support rod 5. In some embodiments, the female receptacle 30 of the percussion accessory 1 is hexagonal in cross section and the support rod 5 is a standard hex drum key. In some embodiments, the female receptacle 30 of the accessory 1 is circular in cross section and engagement with a complementary circular shaft 4 of the support rod 5 permits rotation of the percussion accessory 1. The female receptacle 30 of the accessory 1 may be deliberately oversized in diameter with respect to the shaft 4 of the support rod 5 to permit rotation of the percussion accessory 1.

As shown in FIGS. 1A-1D, in some embodiments, the percussion accessory 1 comprises a reversible securing mechanism to prevent accidental disengagement of the accessory 1 from the support rod 5 while the drum is being played. As shown in FIG. 1B, in some embodiments, the accessory 1 comprises a threaded female receptacle 3 that is complementary to a threaded shaft 4 of the support rod 5. As shown in FIG. 1C, in some embodiments, the support rod 5 comprises a groove 8 near the proximal end 9 for engagement with the accessory 1, and the female receptacle 30 on the accessory 1 comprises a ball bearing connector 10 in a sidewall 11 of the receptacle 30, wherein the ball bearing connector 10 reversibly engages the groove 8 to secure the accessory 1 to the support rod 5. In some embodiments, the ball bearing connector 10 may be embedded in the shaft 4 of the support rod 5 and may interact with a groove in the sidewall 11 of the receptacle 30. As shown in FIG. 1A, in some embodiments, the percussion accessory 1 is reversibly secured to the support rod 5 by an engagement means 36 such as a magnet 35 positioned such that it operably engages and holds in place a support rod 5 (or other object) made of a sufficiently ferrous material to be magnetic.

As shown in FIG. 1D, in some embodiments, the support rod 5 comprises a recess 13 near the proximal end 9 for engagement with the accessory 1 and the female receptacle 30 on the accessory 1 comprises an aperture 12 through a sidewall 11 configured to align with the recess 13 in the support rod 5, wherein the percussion accessory 1 may be reversibly secured to the support rod 5 by insertion of an engagement means 36 through the aperture 12 and into the recess 13. In some embodiments, the recess 13 in the support rod 5 may comprise an aperture that passes through the entire width of the support rod 5. In some embodiments the recess 13 in the support rod 5 may be threaded. In some embodiments, the engagement means 36 is as a pin, set screw, cotter pin, or other connector as may be known in the art.

Figure 7:
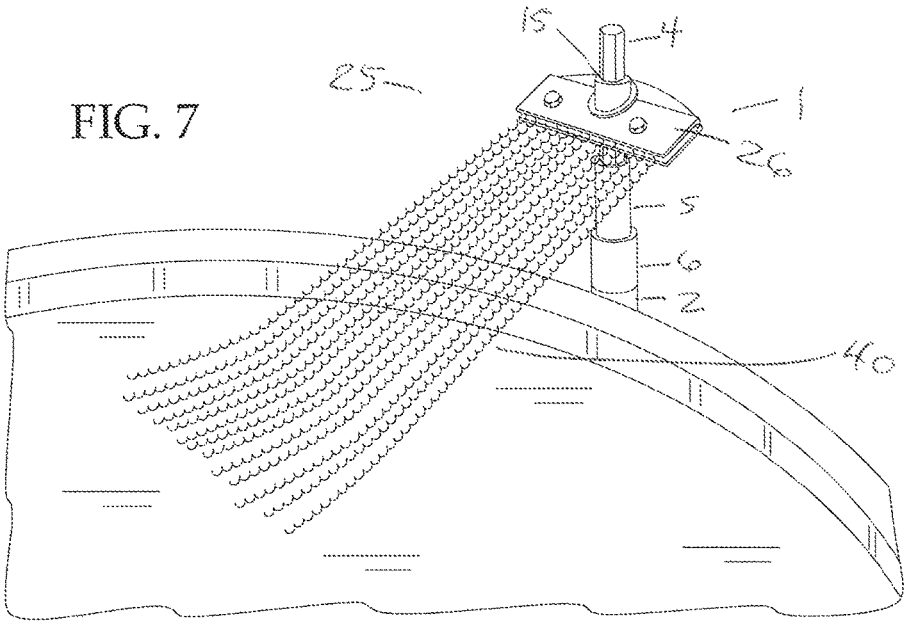
FIG. 7 shows a snare wire accessory attached to a drum according to one embodiment.
Figure 8:
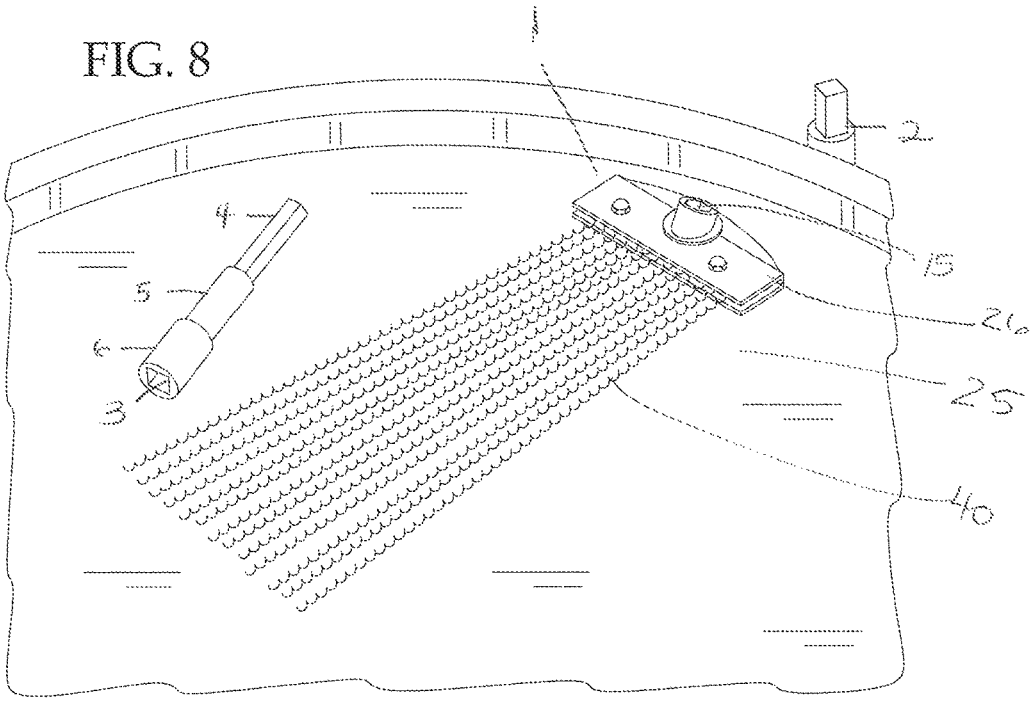
FIG. 8 shows an alternative disassembled view of the snare wire accessory of FIG. 7.

As shown in FIGS. 7 and 8, in some embodiments, a percussion accessory 1 is adapted to be removably attached to the head of a drum tension rod 2 in that the accessory 1 comprises an aperture 15 that is complementary to the shaft 4 of a support rod 5 mounted on the head of a drum tension rod 2, wherein the aperture 15 is sized and configured to allow insertion of the support rod 5 through the aperture 15. In some embodiments the percussion accessory 1 may be secured to the support rod 5 by a removable cap that is complementary to the shaft 4. In some embodiments, the removable cap and the shaft 4 of the support rod 5 may be threaded. In some embodiments the shaft 4 of the support rod 5 may be threaded, and the percussion accessory 1 may be secured to the support rod 5 by a threaded nut. In some embodiments aperture 15 is hexagonal and the support rod 5 is a standard hex drum key. In some embodiments, the aperture 15 is sized and configured to allow the female end of a standard handled drum key to pass through and engage with the head of a drum tension rod 2.

In some embodiments, the support rod 5 may be an integral component of the percussion accessory 1. In such embodiments, a percussion accessory 1 comprises a permanently affixed connection rod wherein the shaft 4 of the rod is mounted, secured, embedded, or formed into the base of the percussion instrument, and the distal end 6 of the support rod 5 comprises a female receptacle 3 with a shape complementary to the head of a drum tension rod 2.

As shown in FIGS. 2 and 3, in some embodiments, the percussion accessory 1 comprises one or more jingles 16 mounted on a central upright 19 wherein the upright has a top end 17 and a bottom end 18, and wherein the distal end 6 of the support rod 5 comprises a female receptacle 3. In some embodiments, the bottom end 18 of the central upright 19 is a female receptacle 30 complementary to the shaft 4 of a drum key. In some embodiments, the bottom end 18 of the central upright 19 is a female receptacle 3 complementary to the head of a drum tension rod 2.

Figure 4:
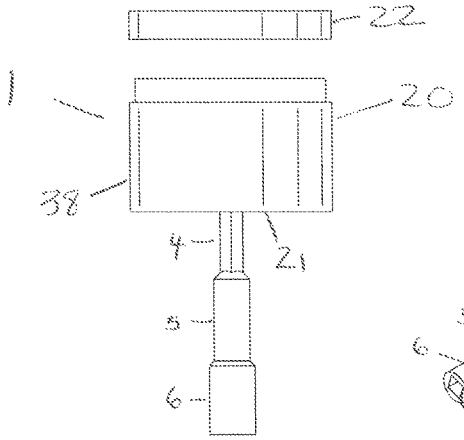
FIG. 4 shows a side view of a shaker percussion accessory and removable lid.
Figure 5:
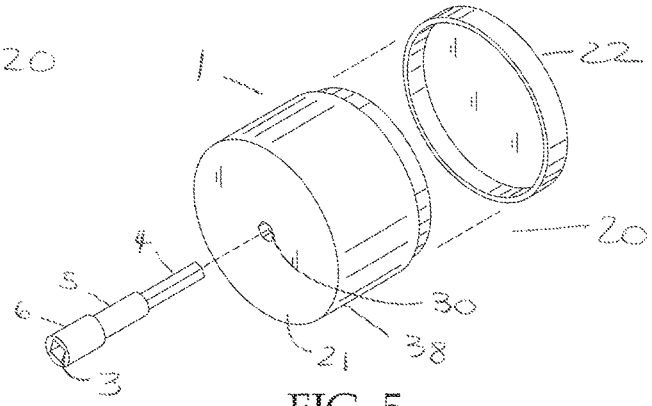
FIG. 5 shows an alternative view of the shaker percussion accessory of FIG. 4.
Figure 6:
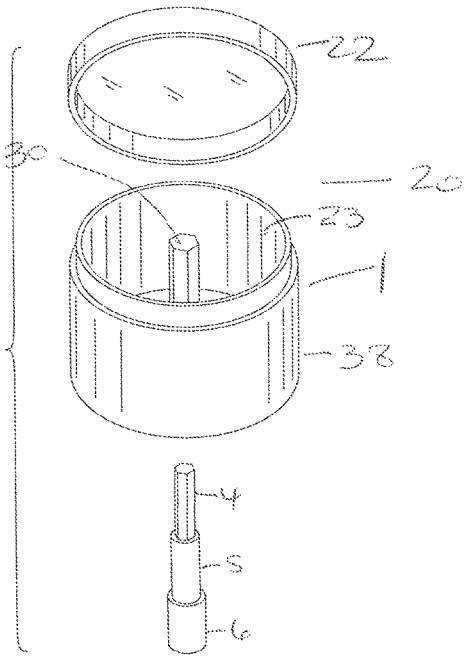
FIG. 6 shows an interior view of the shaker percussion accessory of FIGS. 4 and 5.

As shown in FIGS. 4-6, in some embodiments, the percussion accessory 1 comprises a shaker 20, wherein the shaker 20 is a molded, hollow cylindrical cup 38 with bottom surface 21 and a reversibly attachable lid 22. In some embodiments, the shaker 20 comprises a female receptacle 30 formed into the bottom surface 21 of the shaker 20. In some embodiments the receptacle 30 may be recessed from the bottom surface 21 of the shaker 20 into the interior portion 23. In some embodiments the female receptacle 30 may be disposed on the distal end of a post extending downward from the bottom 21 of the shaker. In some embodiments, the shaker 21 comprises a permanently affixed connection rod mounted, secured, embedded, or formed into the bottom surface of the shaker, wherein the drum end of the connection rod comprises a female connection with a shape complementary to the head of drum tension rod 2.

As shown in FIGS. 7 and 8, in some embodiments, the percussion accessory 1 is a snare wire 25 comprising a collar 26 and wires 40. In some embodiments, the collar 26 further comprises an aperture 15 complementary to the shaft 4 of a support rod 5 such that the collar 26 may be removably slipped over the end of the shaft 4 to secure the percussion accessory 1 in position. In some embodiments, the collar 26 comprises a female receptacle 30 complementary to the shaft 4 of a support rod 5. In some embodiments, the collar 26 comprises an integral rod with a drum end complementary to the head of a drum tension rod 2.

In some embodiments, a support rod 5 can be attached to a standard percussion accessory 1 to permit its attachment to the head of a drum tension rod 2. In such embodiments, a support rod 5 comprises a drum end and an accessory end, wherein the drum end is complementary to the head of drum tension rod 2 and a clamp is secured adjacent to the accessory end of the shaft, wherein the clamp may be of any type known to persons of ordinary skill in the art including, but not limited to, a spring clamp, pinch clamp, c-clamp, pipe clamp, or hose clamp.

Although the foregoing embodiments describe application to a shaker, jingle, and snare wire, it will be appreciated that any small, hand-held percussion instruments may be made suitable for the disclosed adaptation for securement to the head of a drum tension rod. Further, although the discussion has been with reference to, and the figures show, drums such as snares and toms often configured in a set and played with sticks, it should be understood that the present invention is applicable to, and adaptable for use with, other types of percussion instruments including timpani or kettledrums, certain types of bongos, and similar instruments in which a hardware element with a head is proximate to the playing surface of the instrument.

We claim:

1. A percussion accessory for connection to a head of a drum tension rod, said head having a first cross sectional shape, comprising:

a support rod comprising a distal end and a proximal end, wherein the distal end comprises a first female receptacle having a cavity of said first cross sectional shape sized to receive said head, and the proximal end comprises a shaft having a second cross sectional shape; and a percussion instrument with a second female receptacle; wherein the second female receptacle has a cavity of said second cross sectional shape sized to received said shaft.

2. The percussion accessory of claim 1 wherein the support rod is a hex drum key.

3. The percussion accessory of claim 1 wherein said second cross sectional shape is polygonal.

4. The percussion accessory of claim 1 wherein the second cross sectional shape is circular.

5. The percussion accessory of claim 1 wherein the percussion instrument further comprises a ball bearing connector along an interior wall of the second female receptacle, and the support rod further comprises a circumferential groove around the shaft of the support rod, wherein insertion of the shaft of the support rod into the second female receptacle engages the ball bearing connector in the circumferential groove.

6. The percussion accessory of claim 1 wherein the percussion instrument further comprises an aperture through a wall of the second female receptacle, the support rod further comprises a recess in the shaft of the support rod, wherein insertion of the shaft of the support rod into the second female receptacle aligns the aperture and the recess, and wherein the percussion instrument is secured to the support rod by a pin.

7. The percussion accessory of claim 1 wherein the second female receptacle is magnetic.

8. The percussion accessory of claim 1 wherein the second female receptacle is threaded and the shaft of the support rod is threaded.

9. The percussion accessory of claim 1 wherein the percussion instrument is a jingle.

10. The percussion accessory of claim 1 wherein the percussion instrument is a shaker.

11. The percussion accessory of claim 1 wherein the percussion instrument is a snare wire.

12. A percussion accessory for connection to the head of a drum tension rod, said head having a first cross sectional shape, comprising:

a support rod comprising a distal end and a proximal end, wherein the proximal end comprises a shaft and the distal end comprises a first female receptacle having a cavity of said first cross sectional shape sized to receive said head; and a percussion instrument with an aperture, wherein the aperture is configured to slideably pass the shaft of the support rod therethrough.

13. A percussion accessory for connection to a head of a drum tension rod said head having a cross sectional shape, said percussion accessory comprising a percussion instrument having an integral support rod extending from said instrument, said support rod having a distal end comprising a female receptacle having a cavity of said cross sectional shape sized to receive said head.

14. An adapter for connecting a percussion instrument to a head of a drum tension rod, said adapter comprising a support rod with a proximal end and a distal end, the distal end comprising means for connecting to said head, the proximal end comprising means for attaching said support rod to a percussion accessory.

* * * * *